US007444913B2

(12) United States Patent
Shibata et al.

(10) Patent No.: US 7,444,913 B2
(45) Date of Patent: Nov. 4, 2008

(54) PARALLEL FENCES

(75) Inventors: Yoshinori Shibata, Anjo (JP); Masaaki Uchida, Anjo (JP)

(73) Assignee: Makita Corporation, Anjo (JP)

( * ) Notice: Subject to any disclaimer, the term of this patent is extended or adjusted under 35 U.S.C. 154(b) by 286 days.

(21) Appl. No.: 11/240,472

(22) Filed: Oct. 3, 2005

(65) Prior Publication Data

US 2006/0070503 A1 Apr. 6, 2006

(30) Foreign Application Priority Data

Oct. 4, 2004 (JP) ..... 2004-291567

(51) Int. Cl.
*B27B 27/10* (2006.01)
*B27B 27/02* (2006.01)

(52) U.S. Cl. ..... 83/446; 83/438; 83/441; 83/477.2; 83/581; 144/253.1; 144/287

(58) Field of Classification Search ..... 83/438, 83/441, 446, 471.3, 472, 473, 477, 477.1, 83/477.2, 478, 486, 486.1, 487–490, 581; 144/253.1, 286.1, 287, 307; 269/74, 81, 269/318

See application file for complete search history.

(56) References Cited

U.S. PATENT DOCUMENTS 2,630,845 A * 3/1953 Eschennburg ..... 83/438
2,806,493 A * 9/1957 Gaskell ..... 83/438
3,011,531 A * 12/1961 Gaskell ..... 83/438
4,658,687 A * 4/1987 Haas et al. ..... 83/438
4,846,036 A * 7/1989 Metzger et al. ..... 83/438
6,360,641 B1 * 3/2002 Talesky et al. ..... 83/438

FOREIGN PATENT DOCUMENTS

JP Y2 07-30324 7/1995

* cited by examiner

*Primary Examiner*—Boyer D. Ashley
*Assistant Examiner*—Edward Landrum
(74) *Attorney, Agent, or Firm*—Oliff & Berridge, PLC

(57) ABSTRACT

A parallel fence includes a fence body, a front guide, a rear guide, and a positioning device. The fence body is adapted to be placed on a worktable. The front guide and the rear guide are disposed on the front end and the rear ends of the fence body. In a first operational position, the front and rear guides are fixed in position relative to the front and rear guides. In a second operational position, the front and rear guides are prevented from being removed from the front and rear rails in a first direction upwardly away from a surface of the worktable, but the front and rear guides are permitted to move in a second direction along the length of the front and rear rails. In a third operational position, the front and rear guides are permitted to be removed from the front and rear rails in the first direction.

1 Claim, 10 Drawing Sheets

PARALLEL FENCES

This application claims priority to Japanese patent application serial number 2004-291567, the contents of which are incorporated herein by reference.

BACKGROUND OF THE INVENTION

Field of the Invention

The present invention relates to parallel fences, and in particular to fences that have a fence body able to be placed on a worktable, front and rear guides respectively disposed on the front and rear ends of the fence body, and a positioning device for respectively positioning the front and rear guides relative to front and rear rails disposed on the worktable.

Various types of parallel fences are known in the art. For example, Japanese Utility Model Publication No. 7-30324 teaches a parallel fence that is used with a table saw having a circular saw blade. The parallel fence includes a fence body, front and rear guides respectively disposed on the front and rear ends of the fence body, and a positioning device for respectively positioning the front and rear guides relative to front and rear rails that are mounted to a worktable and extend in the right and left directions.

In order to cut a workpiece into a predetermined size one side of the workpiece is pressed against the fence body and the workpiece is then moved along the fence body toward the circular saw blade. If it is desired to change the cutting size of a workpiece, the front and rear guide may be moved along the front and rear rails by releasing a positioning device. Thereafter, the front and rear guides may be again fixed in desired positions relative to the front and rear rails.

However, releasing the positioning device may permit the front and rear guides to be removed upward from the front and rear rails. Therefore, there has been a possibility for the accidental removal of the parallel fence from the worktable during the operation for moving the parallel fence in the right and left directions. For this reason, the conventional parallel fence has a problem in usability.

SUMMARY OF THE INVENTION

It is accordingly an object of the present invention to teach improved techniques that enable the positioning of the parallel fences to be easily adjusted relative to a worktable.

In one aspect of the present teachings, parallel fences are taught that include a fence body, a front guide, a rear guide, and a positioning device. The fence body is adapted to be placed on a worktable. The front guide and the rear guide an: respectively disposed on the front end and the rear end of the fence body. The positioning device serves to position and fix the front guide and the rear guide relative to a front rail and a rear rail disposed on the worktables. The positioning device is operable in a first operational position, a second operational position, and a third operational position. In the first operational position the front and rear guides are respectively fixed in position relative to the front and rear rails. In the second operational position, the front and rear guides are prevented from being removed from the front and rear rails in a first direction upwardly away from a surface of the worktable. However, the front and rear guides are permitted to move in a second direction along the length of the front and rear rails. In the third operational position, the front and rear guides are permitted to be removed from the front and rear rails in the first direction.

In the second operational position the parallel fence may not be accidentally removed from the worktable because the front and rear guides are prevented from being removed from the font and rear rails in a first direction, upwardly away from a surface of the worktable, during the position adjusting operation of the front and rear guides relative to the first and second rails. Therefore, the position adjusting operation can be easily and reliably performed In one embodiment, the positioning device includes a slider, a support mechanism, and a control mechanism. The slider has an engaging portion, such as an engaging claw, engageable with an engaging recess from a lower side of the engaging recess. The engaging recess is formed in one of the front and rear rails. The support mechanism serves to support the slider from the lower side so that the slider can move in a forward and reward direction and can also move to vary a vertical position of the engaging portion. The control mechanism controls the position of the slider so that (1) the slider is pressed against a wall of the engaging recess in the first operational position, (2) the slider is movable in the forward ad rearward directions within the engaging recess in the second operational position, and (3) the engaging portion of the slider is removed from the engaging recess in the id operational position.

Due to the support mechanism supporting the slider from the lower side, in the second operational position the slider is movable in the forward and rearward directions within the engaging recess but may not be removable from the engaging recess. Therefore, the front or rear guide can move along the corresponding rails but may not be removed upward from the corresponding rails.

In order to fix the front or the rear guide in position in the first operational position, the slider may be moved in the forward or rearward direction. However, in order to remove the front or the rear guide, the slider may be moved to vary the vertical position of the engaging portion. For example, the slider may be tilted or may be moved in parallel in a vertical direction. As a result, the movement direction of the slider required for the first operational position and the third operational position are different from each other. Therefore, the mode change option can be reliably performed.

In another embodiment, the positioning device includes an engaging member and an adjusting member. The engaging member is engageable with one of the front and rear rails and is pivotally mounted to one of the front and rear guides about a first axis so that the engaging member can move in the forward and rearward directions. The adjusting member is pivotally mounted to the one of the front and rear guides about a second axis displaced from the first axis. An engaging pin mounted to one of the engaging member and the adjusting ember. An insertion slot is formed in the other of the engaging member and the adjusting member in order to receive the engaging pin. The insertion slot includes a first region and a second region. The first region includes a first portion and a second portion. The first portion engages the engaging pin such that the engaging member is fixed in position about the first axis in the first operational position. The second portion engages the engaging pin such that the engaging member is pivotable within a first range about the first axis in the second operational position. The second region engages the engaging pin such that the engaging member is pivotable within a second range about the third axis in the third operational position. The second range is greater than the first range.

Because the second portion engages the engaging pin such that the engaging member is pivotable within a first range about the second axis in the second operational position, the engaging member may be movable in position relative to the front or rear rail. As a result, the engaging member may be moved along the length of the front or rear rail in order to permit the position adjusting operation.

In addition, because the second region engages the engaging pin such that the engaging member is pivotable within a second range that is greater than the first range, the engaging member may be moved such that the engaging member is completely removed from the first or second rail.

Further, the positioning device is relatively simple in design because the pivotable range of the engaging member in the second and third operational position can be determined by the configurations of the first and second regions.

In a further embodiment, the positioning device includes an operation device that is mounted to the front guide, the rear guide or any other part of the fence body. The operation device is operable to change between the fist operational position, the second operational position, and the third operational position of the positioning device, in this order or in a reverse order. The operation device includes a stopper that may prevent an inadvertent or accidental change from the second operational position to the third operational position.

Because the operational position can be changed by the operation of a single operation device, the operability of the positioning device can be improved. In addition, because the stopper can prevent an accidental change from the second operational position to the third operational position, in this respect the parallel fence may also be prevented from being accidentally removed from the worktable during the positioning operation.

DETAILED DESCRIPTION OF THE INVENTION

Each of the additional features and teachings disclosed above and below may be utilized separately or in conjunction with other features and teachings to provide improved parallel fences. Representative examples of the present invention, which examples utilize many of these additional features and teachings both separately and in conjunction with one another, will now be described in detail with reference to the attached drawings. This detailed description is merely intended to teach a person of skill in the art further details for practicing premed aspects of the present teachings and is not intended to limit the scope of the invention. Only the claims define the scope of the claimed invention. Therefore, combinations of features and steps disclosed in the following detailed description nay not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
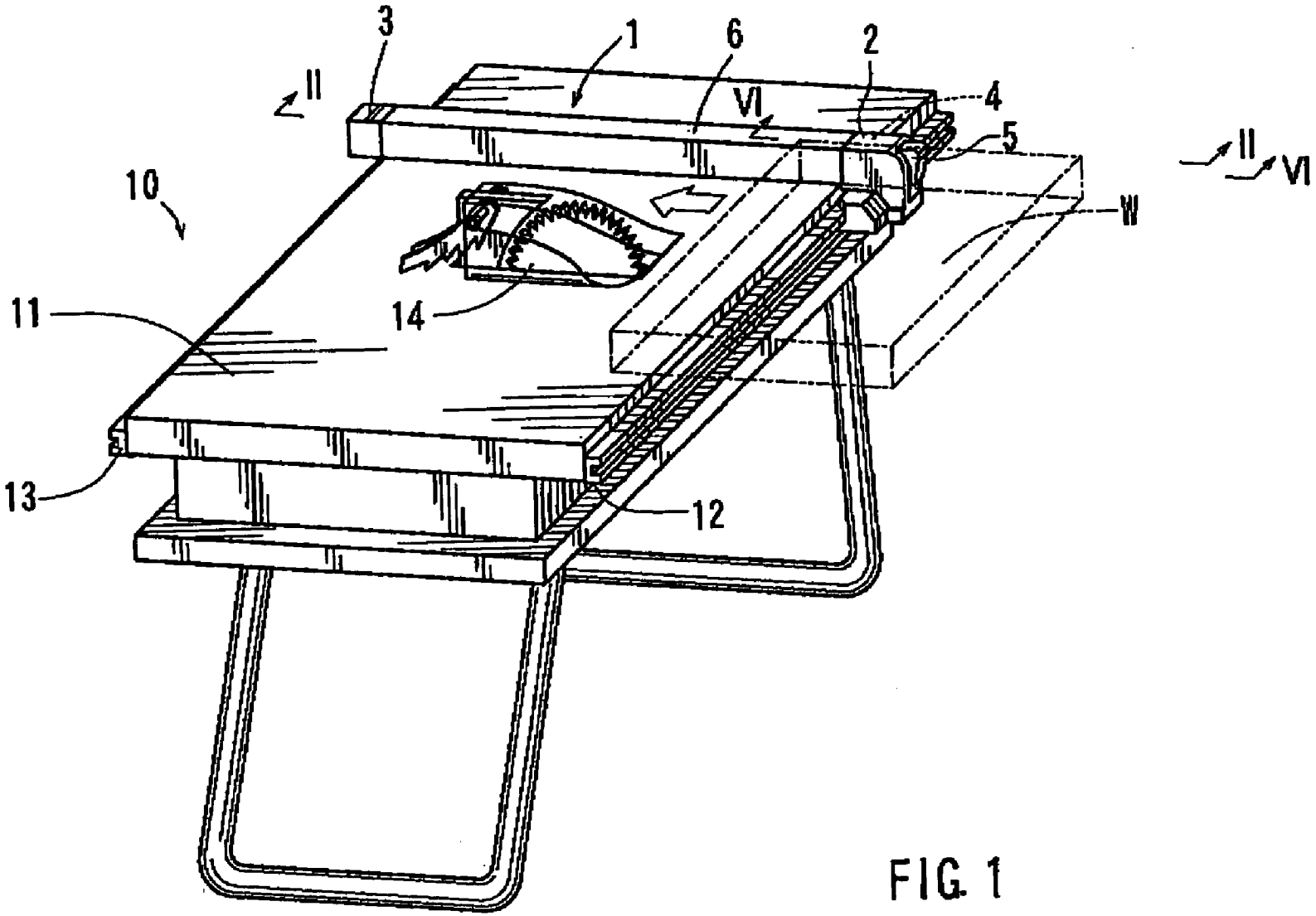
FIG. 1 is a perspective view of a table saw incorporating a representative parallel fence.

A representative embodiment of the present invention will now be described with reference to PIGS. 1 to 10. Referring to FIG. 1, a representative parallel fence 1 is shown as being used for mounting on a worktable 11 of a table saw 10. A circular saw blade 14 is disposed centrally of the worktable 11 and extends partly upward from tie upper surface of the worktable 11. A pair of rails 12 and 13 are mounted to opposite edges of the worktable 11, in which rails 12 and 13 are positioned on the side of an operator (the right side as viewed in FIG. 1) and on the side away from the operator (the left side as viewed in FIG. 1), i.e., the front and rear edges of the worktable 11. The rails 12 and 13 respectively extend linearly in the right and left directions (upward and downward angled directions as viewed in FIG. 1) along the front and rear edges of the worktable 11.

As shown in FIGS. 2 to 5, the rail 12 has a recessed mount portion 12*a* The mount portion 12*a* is opened on a front side (the right side as viewed in FIGS. 2 to 5) and extends along the length of the rail 12. An upper wall portion of the mount portion 12*a* defines an engaging recess 12*b* that opens downward. Similarly, the rail 13 has a recessed mount portion 13*a* The mount portion 13*a* is opened on a rear side (the left side as viewed in FIGS. 2 to 5) and extends along the length of the rail 13. An upper wall portion of the mount portion 13*a* defines an engaging recess 13*b* that opens downward.

The parallel fence 1 is mounted to the workpiece and is used for cutting a workpiece W to a predetermined size by the saw blade 14. The parallel fence 1 has a fence body 6, front and rear guides 2 and 3, and a positioning device 4.

The fence body 6 is extended linearly over the worktable 11 so that one side of the workpiece W may be slidably pressed against the fence body 6. With the workpiece W pressed against one side of the fence body 6, the operator may push the workpiece W along one side of the fence body 6 toward the saw blade 14. As a result, the workpiece W can be cut to have a predetermined size.

Figure 2:
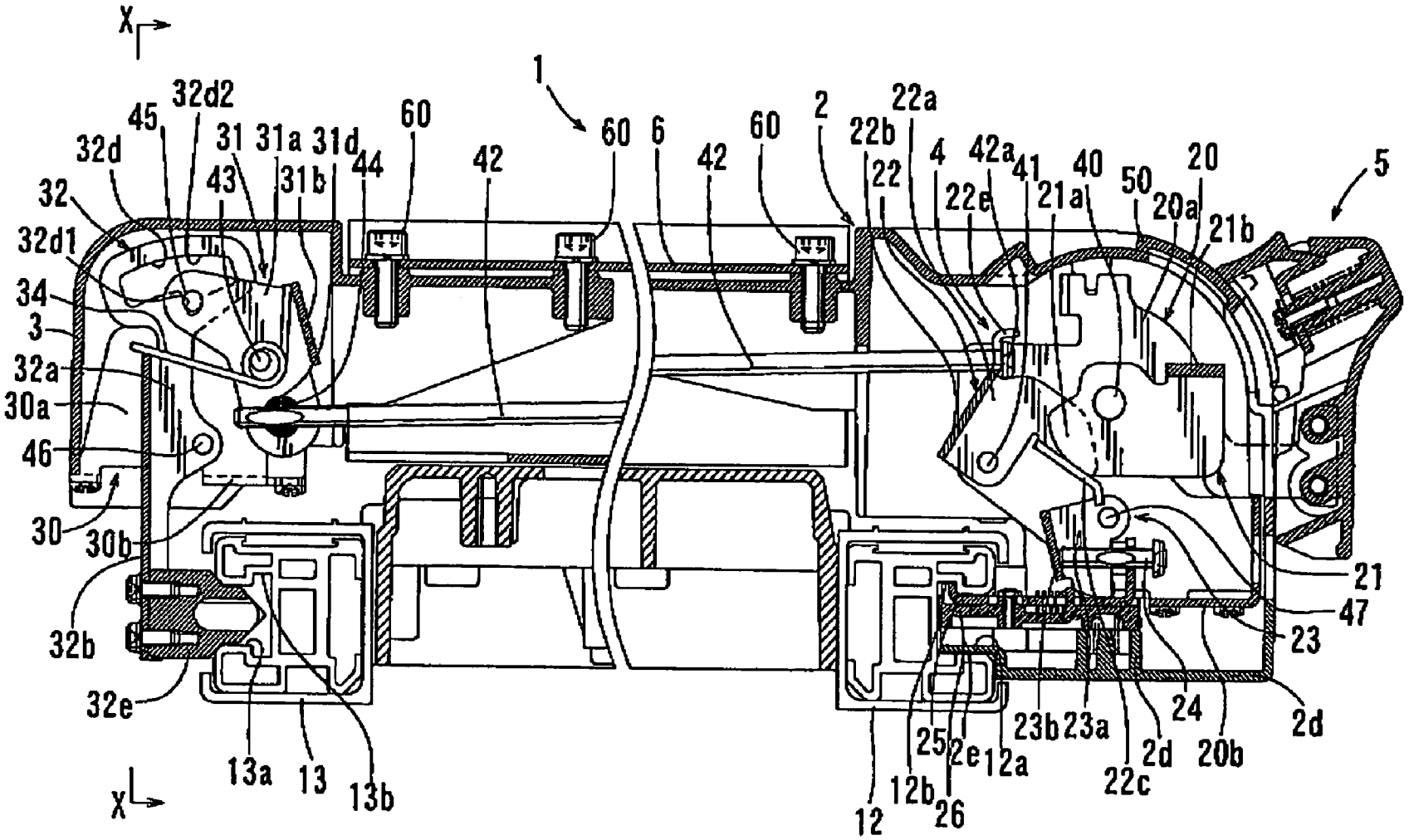
FIG. 2 is a cross-sectional view of the parallel fence taken along line II-II in FIG. 1 and showing the fixed state of the parallel fence.

The front and re guides 2 and 3 at respectively secured to the front and rear ends of the fence body 6 by means of bolts 60 (see FIG. 2). The fence body 6 and the front and near guides 2 and 3 have hollow structures. Almost all of the components of the positioning device 4 are disposed within the hollow structures of the fence body 6 and the front and rear guides 2 and 3.

The positioning device 4 is operable to respectively fix the front and rear guides 2 and 3 in position relative to the front and rear rails 12 and 13. The positioning device 4 has a front side mechanism disposed within the front guide 2, a rear side mechanism disposed within the rear guide 3, and a rod 42 connecting the front and rear side mechanisms and disposed within the fence body 6 as shown in FIG. 2. The front side mechanism includes a support 20, a cam 21, a book 22, a stay 23, a slider 25, and a slider support 26. The support 20 is secured within the front guide 2. The cam 21 is vertically pivotally mounted to the support 20. The slider 25 is slidable in forward and rearward directions relative to the guide 3 and is supported by the slider support 26 from the lower side.

Figure 9:
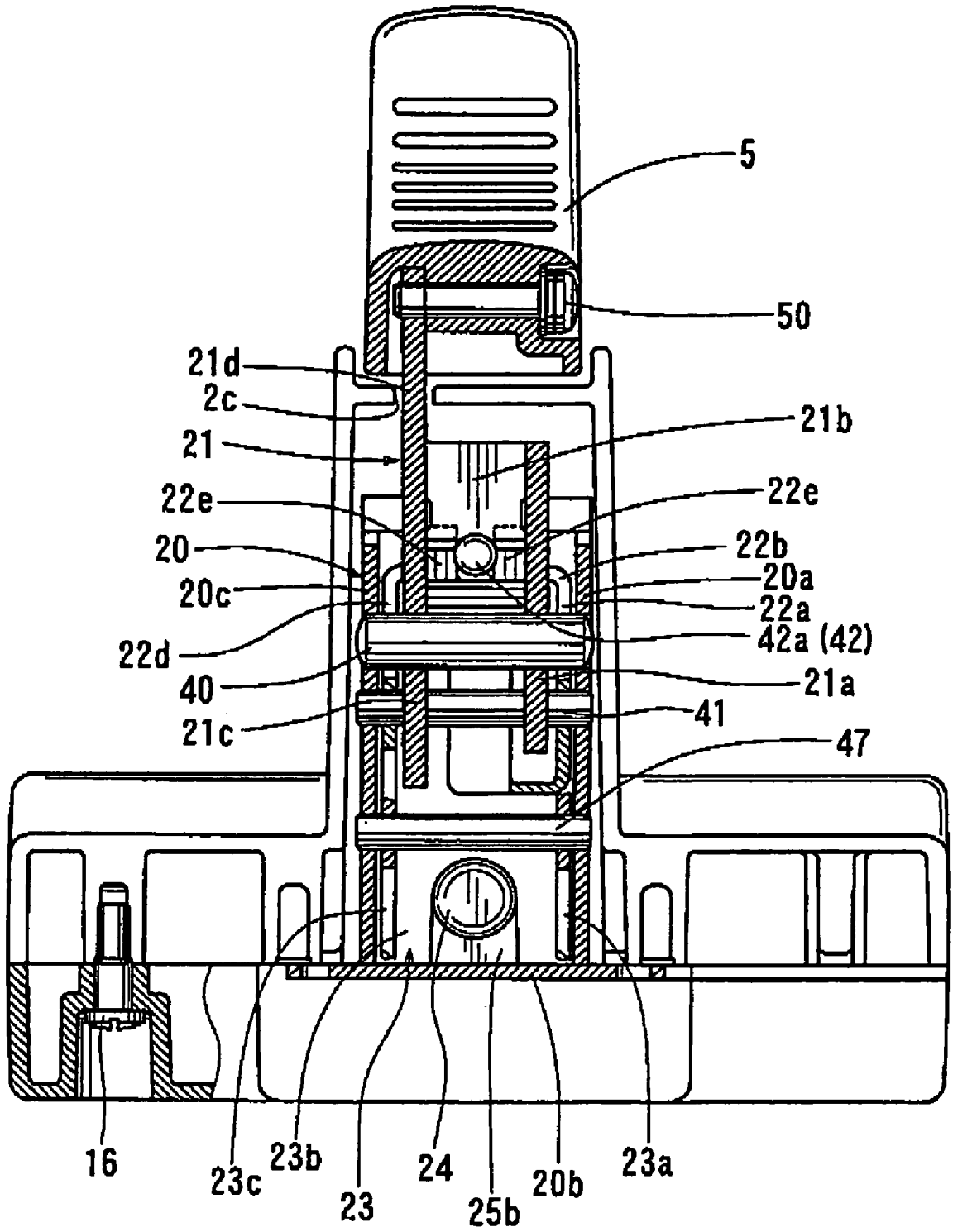
FIG. 9 is a cross-sectional view taken along line IX-IX in FIG. 4.

As shown in FIG. 9, the support 20 includes a right-side portion 20*a*, a left-side portion 20*c*, and a mount portion 20*b* secured to the guide 2 (FIG. 2). The mount portion 20*b* connects together the right side and left side portions 20*a* and 20*c*.

Figure 6:
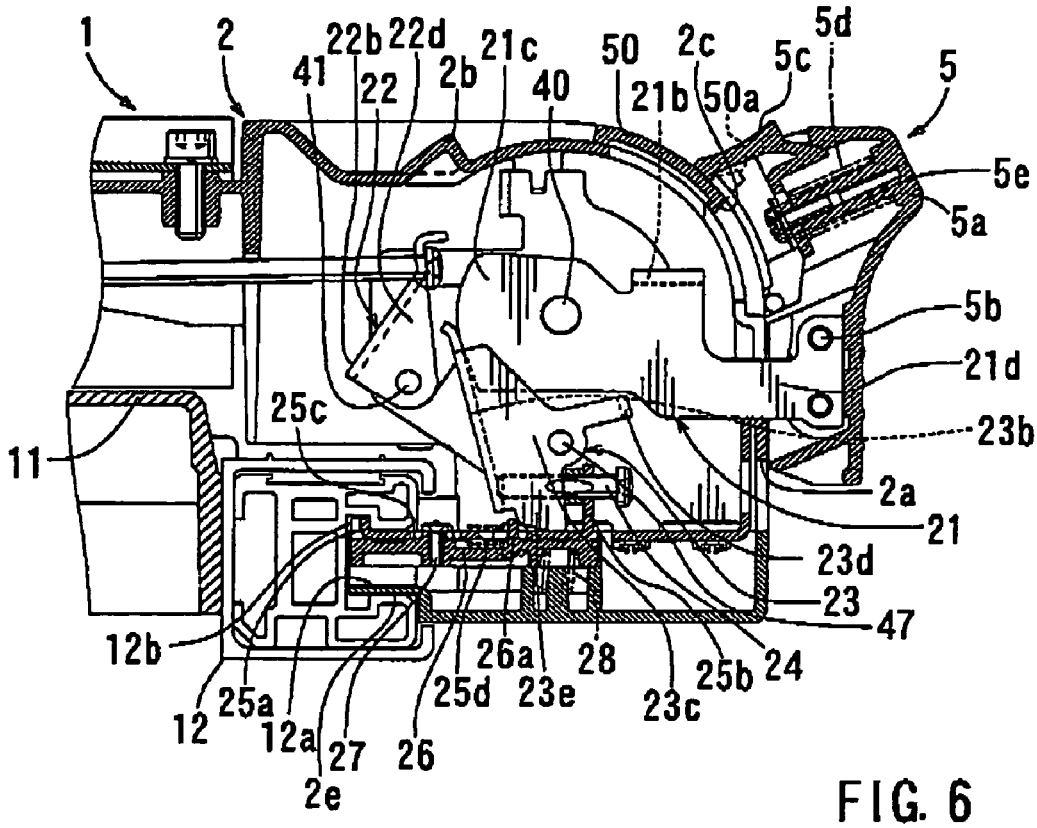
FIG. 6 is a cross-section view of the parallel fence taken along line VI-VI in FIG. 1.

As shown in FIG. 2, the cam 21 has a first cam 21*a*, a connecting portion 21*b*, and a second cam 21*c* (see FIG. 6). The connecting portion 21*b* connects the first and second cams 21*a* and 21*c* and extends perpendicular thereto. As shown in FIG. 9, a pivot pin 40 pivotally supports the fist and second cams 21*a* and 21*c* so that the cam 21 can incline relative to the support 20

As shown in FIG. 2, the hook 22 has a book body 22*a*, a connecting portion 22*b*, a force receiving portion 22*c*, and a reinforcing portion 22*d* (see FIG. 6). The connecting portion 22*b* connects the hook body 22*a* and the reinforcing portion 22*d* and extends perpendicular thereto. The hook body 22*a* and the reinforcing portion 22*d* are pivotally supported by a pivot pin 41 so that the hook 22 can incline relative to the support 20. As shown in FIG. 9, two extensions 22*e* are formed on the upper portion of the connecting member 22*b*. A portion of the rod 42, proximate to an enlarged head 42*a*, is received between the extensions 22*e* so that the head 42*a* is engaged by the extensions 22*e*.

Bending the hook body 22*a* forms the force receiving portion 22*c*. The force receiving portion 22*c* extends perpendicular to the hook body 22*a*. In addition, the force receiving portion 22*c* serves to contact with the outer peripheral edge of the first cam 21*a* so that the pivotal movement of the hook member 22 in a counterclockwise direction, as viewed in FIG. 2, is restricted by the contact between the force receiving portion 22*c* and the first cam 21*a*.

The stay 23 has a stay body 23*c* (shown in FIG. 6). The stay 23 also has an auxiliary portion 23*a* and a first force receiving portion 23*b* shown in FIG. 2, and a second force receiving portion 23*d* shown in FIG. 6. The first force receiving portion 23*b* connects the stay body 23*c* and the auxiliary portion 23*a* and extends perpendicular thereto. As shown in FIG. 9, a pivot pin 47 supports the stay body 23*c* and the auxiliary portion 23*a* so that the stay 23 can incline relative to the support 20.

The second force receiving portion 23*d* is formed by bending a part of the stay body 23*c* so that the second force receiving portion 23*d* extends perpendicular to the stay body 23*c*. The outer peripheral edge of the second cam 21*c* contacts the second force receiving portion 23*d*. The fist force receiving portion 23*b* is positioned on a side opposite to the second force receiving portion 23*d* with respect to the pivotal pin 47. In addition, the fit force receiving portion 23*b* contacts with the outer peripheral edge of the second cam 21*c* at a different contact point opposite to the contact point of the second force receiving portion 23*d* with respect to the pivotal pin 40.

Figure 8:
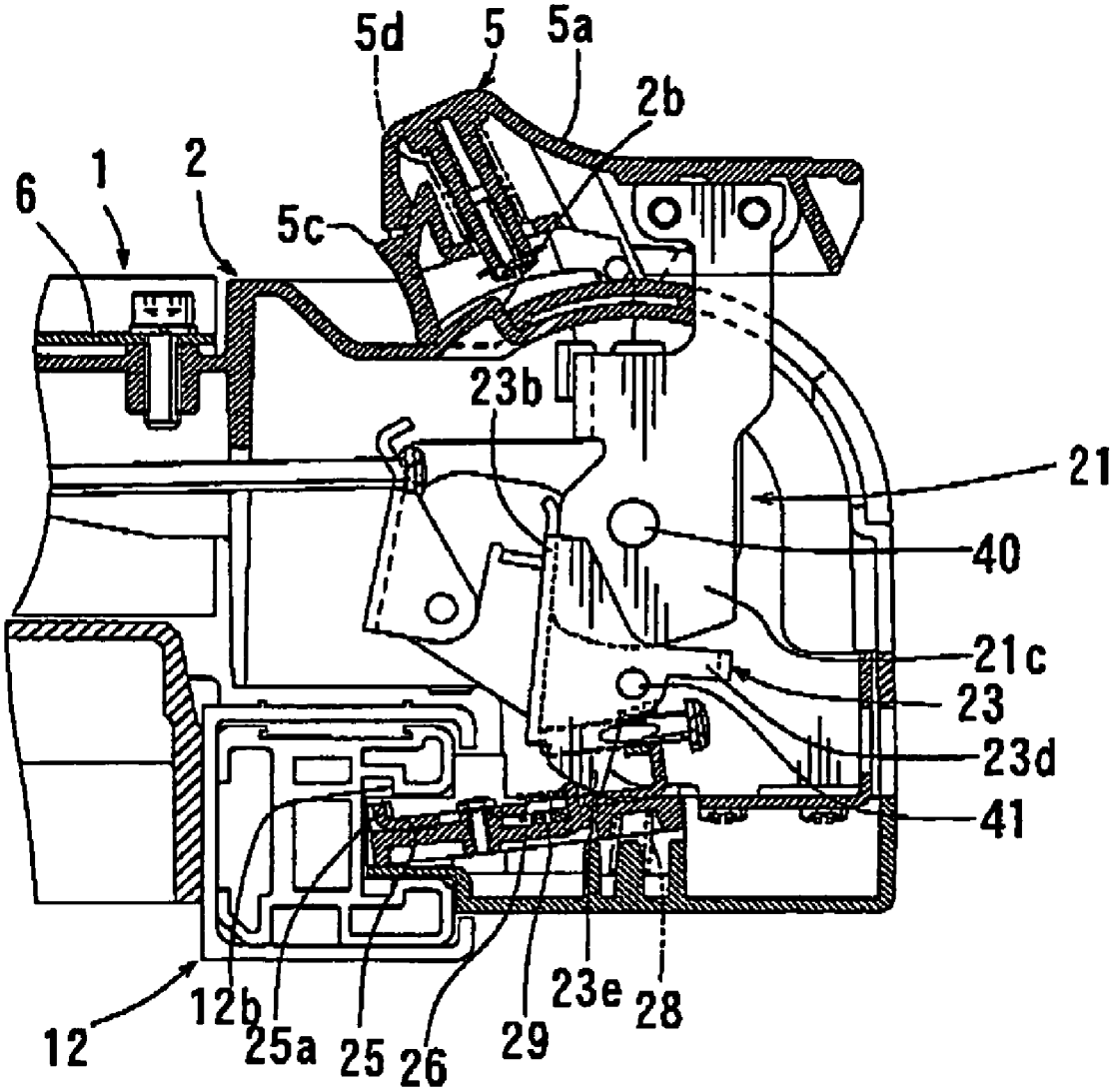
FIG. 8 is a cross tonal view similar to FIG. 6 but showing the removing and mounting state.

Therefore, as the cam 21 pivots in the counterclockwise direction from the position shown in FIG. 6 to the position shown in FIG. 8, the second cam 21*c* may contact with the second force receiving portion 23*d* so that the stay 23 pivots in a clockwise direction. On the contrary, as the cam 21 pivots in the clockwise direction from the position shown in FIG. 8 to the position shown in FIG. 6, the second cam 21*c* may contact with the first force receiving portion 23*b* so that the stay 23 pivots in a counterclockwise direction.

As shown in FIG. 6, a backup portion 23*e* is formed to extend from the lower portion of the stay body 23*c*. The backup portion 23*e* has a substantially arc-shaped outer edge in order to engage the upper surface of the slider 25 from the upper side, as will be explained later.

Figure 11:
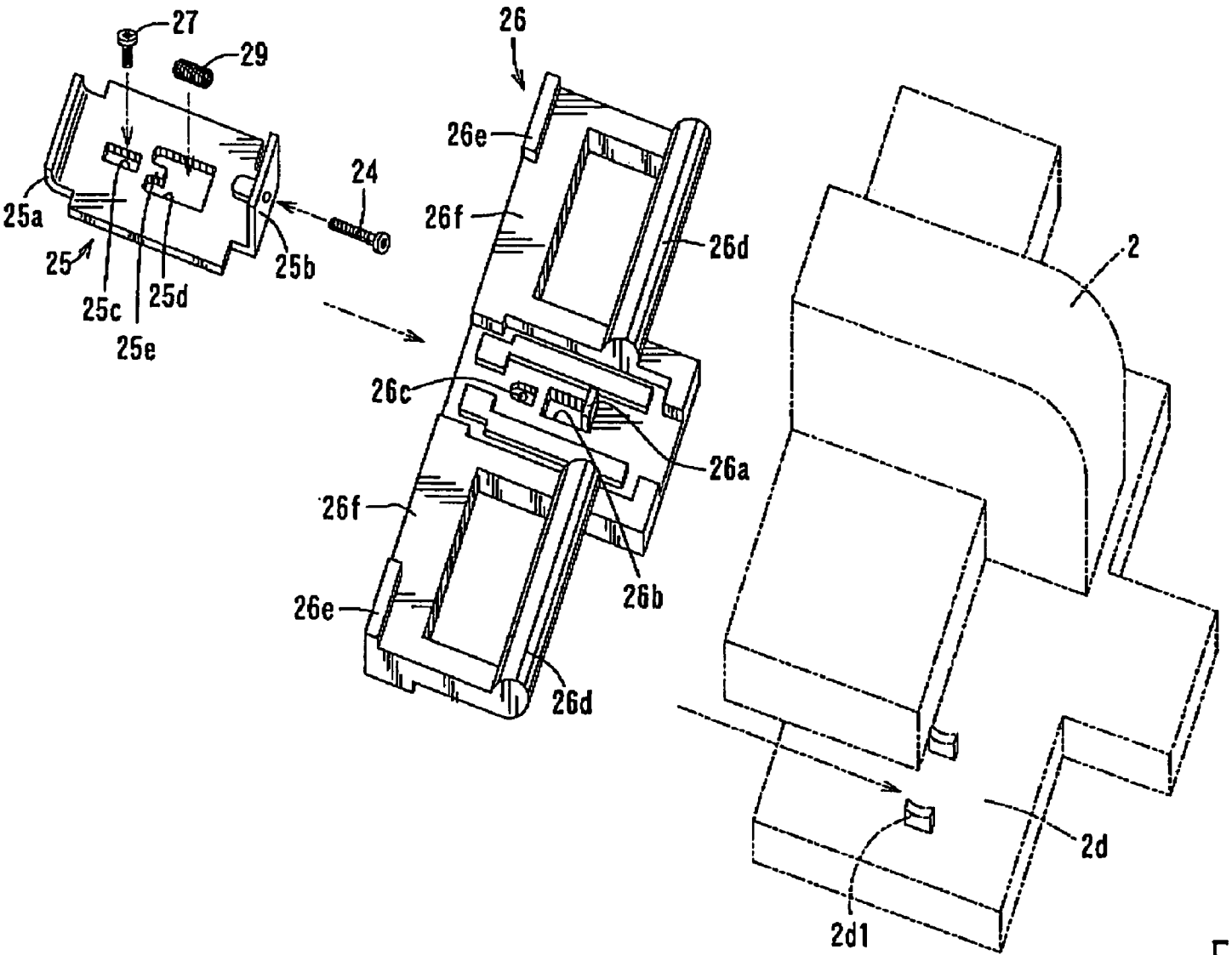
FIG. 11 is an exploded perspective view showing a slider and a slider support.

As shown in FIGS. 6 and 11, the slider 25 extends in forward and rearward directions (right and left directions as viewed in FIG. 6). As shown in FIG. 11, an engaging claw 25*a* and an upright portion 25*b* are respectively formed on the rear end and the front end of the slider 25. The engaging claw 25*a* is curve upward from the slider 25 and engages with a downwardly oriented engaging recess 12*b* farmed in the rail 12.

An adjusting screw 24 is engaged with the upright portion 25*b* in the forward and rearward directions. An appropriate tool, such as a screwdriver (not shown), may adjust the position of the adjusting screw 24 relative to the upright portion 25*b* by inserting the appropriate tool though an opening 2*a* formed in the front guide 2 (see FIGS. 6 and 7).

The end portion of the adjusting screw 24 may contact with the first force receiving portion 23*b* of the stay 23. Thus, as the stay 23 pivots in the counterclockwise direction the first force receiving portion 23*b* may contact with the end portion of the adjusting screw 24, forcing the slider 25 to move in the forward direction. On the contrary, as the stay 23 pivots in the clockwise direction, the first force receiving portion 23*b* may move away from the end portion of the adjusting screw 24 so that the slider 25 may be permitted to move rearward.

As shown in FIG. 6, the slider support 26 serves to support the slider 25 from the lower side and has a threaded hole 26*c* and a bottomed recess 26*b* formed therein (see FIG. 11). The slider support 26 also has a projection 26*a* A mount screw 27 is inserted into a first elongated slot 25*c* (see FIG. 11) formed in the slider 25 and engages with the threaded hole 26*c* of the slider support 26. Consequently, the slider 25 is prevented from being upwardly removed from the slider support 26. The first elongated slot 25*c* extends in the forward and rearward directions. The projection 26*a* extends upward from the slider support 26 and through a second elongated slot 25*d* formed in the slider 25. The second elongated slot 25*d* also extends in the forward and rearward directions. The projection 26*a* has right and left side edges that respectively slidably contact with right and left edges of the second elongated slot 25*d* so that the projection 26*a* serves as a guide for the forward and rearward movement of the slider 25.

A biasing member 29, such as a compression coil spring, is disposed within the recess 26*b* and has opposite ends that respectively contact with and are supported by the projection 26*a* and a protrusion 25*e*. The protrusion 25*e* is formed on the rear edge of the second elongated slot 25*d* of the slider 25. Therefore, the biasing member 29 biases the slider 25 in a rearward direction relative to the slider support 26.

The slider support 26 has a pair of arms 26*f* extending in the right and left directions from the rear portion of the slider support 26. A rib 26*e* is formed on the upper surface of each of the arms 26*f* and protrudes upward there from. A pair of pivotal shafts 26*d* extends in the right and left directions from the front portion of the slider support 26. The outer ends of the pivotal shafts 26*d* are respectively joined to the corresponding arms 26*f*.

The ribs 26*e* engage with the engaging recess 12*b* of the front rail 12 so that the ribs 26*e* serve as a slide guide device for the right and left movement of the slider support 26. The pivotal shafts 26*d* have cylindrical configurations and are slidably rotatably supported on respective support portions 2*d*1, which are formed on a holder 2*d* of the front guide 2 (see FIG. 11). As a result, the slider support 26 can pivot relative to the holder 2*d* about an axis defined by the pivotal shafts 26*d*.

As shown in FIG. 6, a biasing member 28, such as a compression coil spring, is disposed between the front end of the slider support 26 and the holder 2*d* so that the front end of the slider support 26 is biased in an upward direction. The biasing member 28 is positioned substantially below The backup portion 23*e* of the stay 23 when the stay 23 has pivoted to the positions shown in FIGS. 6 and 7. Therefore, the biasing member 28 may press the front end of the slider support 26 against the arc-shaped outer edge of the backup portion 23*e* so that the slider 25, as well as the slider support 26, may be held to extend in a substantially horizontal orientation.

When the backup portion 23*e* has moved rearward of the biasing member 28, as shown in FIG. 8, the biasing force of the biasing member 28 may lift the front end of the slider support 26. Therefore, the slider support 26 may be inclined so that the engaging claw 25*a*, which is formed on the rear end of the slider 25, moves downward. In this way, the slider 25 can move between a horizontal position and an inclined position via the operation of a support device including the slider support 26, the backup portion 23*e* and the biasing member 28.

Figure 10:
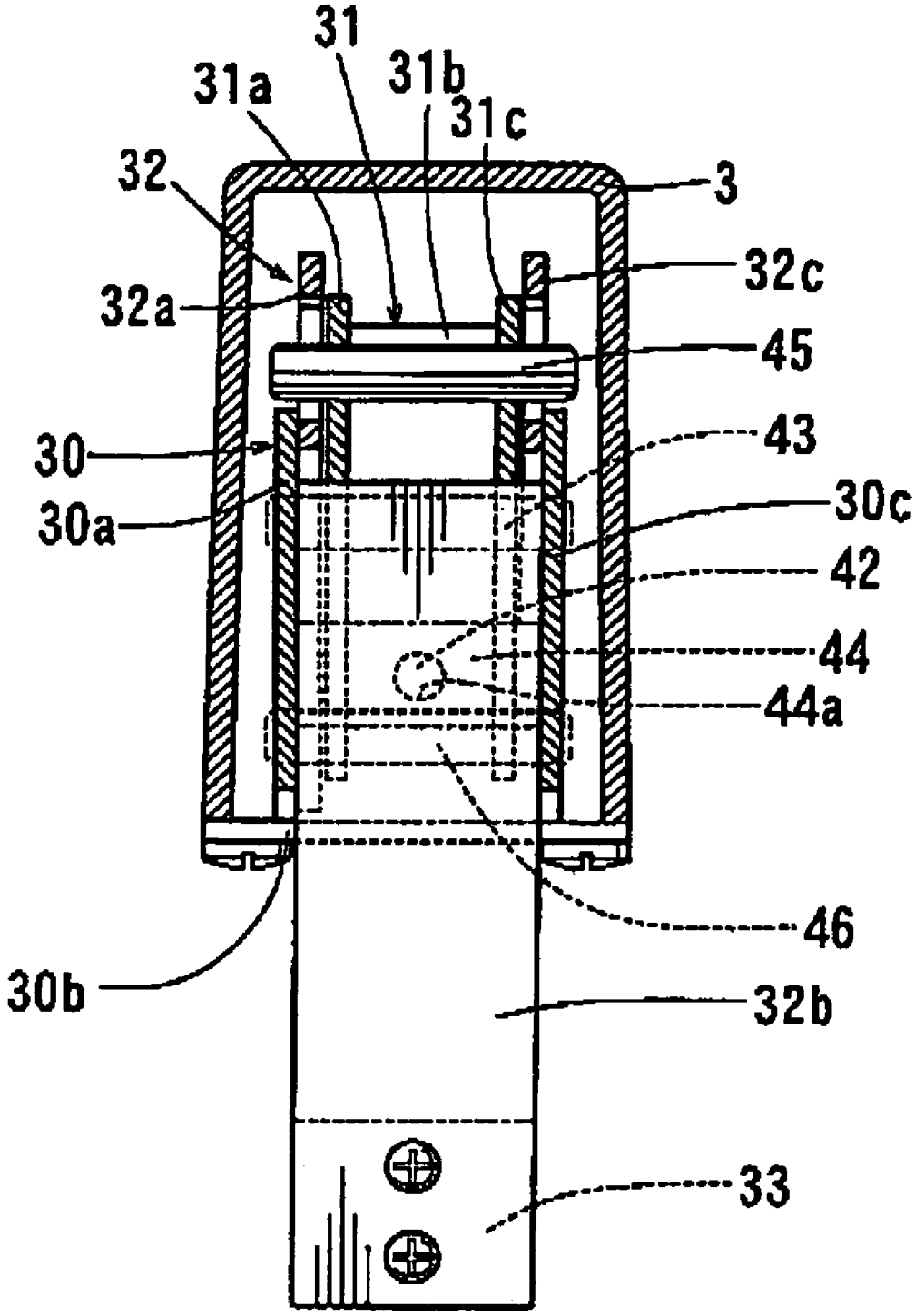
FIG. 10 is a cross-sectional view of the parallel fence taken along line X-X in FIG. 2.

The rear side mechanism of the positioning device 4, which is disposed within the rear guide 3, will now be described As shown in FIG. 2, the rear side mechanism includes a support member 30, an engaging member 32, and an adjusting member 31 that are pivotally mounted to the support member 30. The support member 30 is fixedly mounted within the hollow space defined in the rear guide 3. The adjusting member 31 is pivotally mounted to the support member 30. As shown in FIG. 10, the support member 30 has a pair of support body portions 30*a* and 30*c* and a connecting portion 30*b* that is formed integrally with the support body portions 30*a* and 30*c*. The connecting portion 30*b* connects the lower ends of the support body portions 30*a* and 30*c* and is secured to a lower edge of the rear guide 3, as shown in FIG. 2.

Also as shown in FIG. 2, the engaging member 32 has a first engaging body portion 32*a*, a second engaging body portion 32*c* (see FIG. 10), a connecting portion 32*b*, and an engaging portion 32*e*. The connecting portion 32*b* connects the first and second engaging body portions 32*a* and 32*c* and extends perpendicular thereto. The support member 30 pivotally supports the first and second engaging body portions 32*a* and 32*c* by means of a pivot pin 46.

As shown in FIG. 2, the engaging portion 32*e* is mounted to the lower end of the connecting portion 32*b* that extends downward from a lower edge of the rear guide 3. The engaging portion 32*e* is removably fitted into the mount portion 13*a*, which is disposed within the rail 13, from the rear side of the mount portion 13*a*. Thus, fitting the engaging portion 32*e* into the mount portion 13*a* may fix the engaging portion 32*e* in position with respect to the vertical direction.

An insertion slot 32*d* is famed in the upper portion of the first engaging body portion 32*a* and bas a position adjusting region 32*d*1 and a removing and mounting region 32*d*2. The mounting and removing region 32*d*2 defines a substantially arc-shaped edge that is a part of the circumferential edge of the insertion slot 32*d*. The position adjusting region 32*d*1 has a substantially triangular configuration extending downward from a position opposing to the middle portion of the arc-shape edge defined by the mounting and removing region 32*d*2. Although not shown in the drawings, the insertion slot 32*d* is also formed in the upper portion of the second engaging body portion 32*c*. An engaging pin 45 has opposite ends that are respectively inserted into the insertion slots 32*d* of the first and second engaging body portions 32*a* and 32*c*.

As shown in FIG. 2, the adjusting member 31 has a first adjusting body portion 31*a*, a second adjusting body portion 31*c* (see FIG. 10), and a connecting portion 31*b*. The connecting portion 31*b* connects the first and second adjusting body portions 31*a* and 31*c* and extends perpendicular thereto. The support member 30 pivotally supports the first and second adjusting body portions 31*a* and 31*c* by means of a pivot pin 43.

A shaft 44 is inserted into mounting holes 31*d* that are respectively formed in the lower portions of the first and second adjusting body portions 31*a* and 31*c*. The rear end of the rod 42 is inserted into the shaft 44 along the diametrical direction of the shaft 44. The adjusting member 31 pivots about an axis of the pivot pin 43 as the rod 42 moves in the forward and rearward directions (right and left directions as viewed in FIG. 2).

The opposite ends of the engaging pin 45 are respectively mounted to the upper portions of the first and second adjusting body portions 31*a* and 31*c*.

A biasing member 34, which may be configured as a torsion coil spring, is interposed between the adjusting member 31 and the engaging member 32. The pivot pin 43 is inserted into the central portion (coiled central portion) of the biasing member 34. Opposite ends of the biasing member 34 are respectively engaged with the upper end of the connecting portion 31*b* of the adjusting member 31 and the upper end of the connecting portion 32*b* of the engaging member 32. Therefore, the biasing member 34 biases the engaging member 32 in the counterclockwise direction so that the engaging portion 32*e* is forced towards the mount portion 13*a*. At the same time, the biasing member 34 biases the adjusting member 31 in the clockwise direction so that the rod 42 is forced in the rearward direction (left direction as viewed in FIG. 2).

As shown in FIG. 6, the positioning device 4 includes an operation device 5 and a shielding member 50. The operation device 5 is operable by an operator and includes an operation member 5*a*, a stopper 5*c*, and a biasing member 5*d* that may be a compression coil spring. The operation member 5*a* has a mount portion 5*b* that is secured to a mount arm 21*d* that extends from the second cam 21*c* so that the operation member 5*a* can pivot relative to the front guide 2 together with the second cam 21*c*.

The stopper 5*c* is disposed between the operation member 5*a* and the outer surface of the front guide 2. The stopper 5*c* is also slidably mounted to a shaft portion 5*e* formed within the operation member 5*a* so that the stopper 5*c* can move in the axial direction of the shaft portion 5*e*. The biasing member 5*d* is fitted on the shaft portion 5*e* so that the stopper 5*c* is pressed against the outer surface of the front guide 2 by the biasing force of the biasing member 5*d*. Therefore, the stopper 5*c* slides along the outer surface of the front guide 2 as the operation member 5*a* pivots. A stepped portion 2*b* is formed on the outer surface of the front guide 2 in order to engage the stopper 5*c*. Thus, when the operation member 5*a* has pivoted rearward (leftward as viewed in FIG. 6) from the position shown in FIG. 6 to the position shown in FIG. 7, the stopper 5*c* may abut on the stepped portion 2*b* so that the operation member 5*a* cannot move further. In order to move the operation member 5*a* further rearward, the operator may engage his fingers with the stopper 5*c* and may lift the stopper 5*c* against the biasing force of the biasing member 5*d*. At this point, the operation member 5*a* can be moved further as shown in FIG. 8.

As shown in FIGS. 6 and 9, an elongated slot 2*c* is formed in the front guide 2 so that the mount arm 21*d* can extend outward from the front guide 2 through the elongated slot 2*c*. The elongated slot 2*c* is elongated in forward and rearward din tons in order to permit the movement of the mount arm 21*d* during the operation of the operation member 5*a*. A shielding member 50 is provided for covering the elongated slot 2*c* and can slide along the outer surface of the front guide 2. The stopper 5*c* contacts with the upper surface of the shielding member 50 so that the shielding member 50 can move together with the stopper 5*c* due to the frictional force between the stopper 5*c* and the shielding member 50. However, when the stopper 5*c* abuts on the stepped portion 2*b*, the shielding member 50 also abuts on the stepped portion 2*b*. Therefore, the shielding member 50 cannot move rearward beyond the stepped portion 2*b*. In addition, the shielding member 50 has a projection 50*a* projecting upward from the shielding member 50 toward the operation member 5*a*. Therefore, as the operation member 5*a* moves in the forward direction from the position shown in FIGS. 7 or 8, the stopper 5*c* may engage the projection 50*a* so that the shielding member 50 can be reliably moved forward together with the operation member 5*a* in order to shield the open portion of the elongated slot 2*c*.

The operation of the positioning device 4 will now be described in relation to the operation for fixing the front and rear guides 2 and 3 in position relative to the corresponding rails 12 and 13. In order to fix the front and rear guides 2 and 3 in position the operator may operate the operation member 5*a* to move the operation device 5 from the position shown in FIG. 7 or FIG. 8 to the position shown in FIG. 6, which is the same as the position shown in FIG. 2, where the operation member 5*a* has been pivoted to its stroke end in the forward direction (clockwise direction). With this operation, the first cam 21*a* may force the receiving portion 22*c* to pivot the hook 22 in the clockwise direction so that the rod 42 may be shifted forwardly (rightward as viewed in FIG. 2). The rear end of the rod 42 may then pull the first and second adjusting body portions 31*a* and 31*c* to pivot the adjusting member 31 in the counterclockwise direction. The pivotal movement of the adjusting member 31 in the counterclockwise direction causes the engaging pin 45 to force the engaging member 32 to also pivot in the counterclockwise direction. The engaging pin 45 engages a narrow width portion of the position adjusting region 32*d*1 of the insertion slot 32*d*. Therefore, the engaging portion 32*e* of the engaging member 32 may be pressed and fitted into the mount portion 13*a* of the rear rail 13. As a result, the rear guide 3 may be fixed in position relative to the rear rail 13

At the same time, the second cam 21*c* may force the stay 23 to pivot in a counterclockwise direction so that the stay 23 may move the slider 25 forwardly (rightward as viewed in FIGS. 2 and 6) via the adjusting screw 24. Then, the engaging claw 25*a* of the slider 25 may be pressed against a front sidewall portion (right side wall portion as viewed in FIGS. 2 and 6) of the engaging recess 12*b* of the rail 12. As a result, the front guide 2 may be fixed in position relative to the front rail 12.

The slider 25 is supported from the lower side by the slider support 26. In addition, the biasing member 28 and the backup portion 23*e* hold the slider support 26 in a horizontal position. Therefore, the engaging claw 25*a* is reliably prevented from being removed from the engaging recess 12*b*. Further, as shown in FIG. 2, the front guide 2 has an insertion portion 2*e* that is inserted into the mount portion 12*a*. In the mounted state, the rear end of the insertion portion 2*e* contacts with the back wall of the mount portion 12*a* so that the front guide 2 and consequently the parallel fence 1 are prevented from moving in the rearward direction.

The operation will now be described for enabling the adjustment of the position of the front and rear guides 2 and 3 relative to the respective front and rear rails 12 and 13. In order to enable the adjustment of the position of the guides 2 and 3 the operator may shift the operation member 5*a* of the operation device 5 fogy (leftward) from the position shown in FIGS. 2 and 6 to the position shown in FIGS. 3 and 7 (i.e., where the stopper 5*c* abuts on the stepped portion 2*d* of the front guide 2). With is shifting operation, the first cam 21*a* pivots in a counterclockwise direction in order to permit the hook 22 to also pivot in a counterclockwise direction.

Because the biasing member 34 biases the hook 22 in a counterclockwise direction via the rod 42 and the adjusting member 31, the hook 22 may pivot in the counterclockwise direction from the position shown in FIG. 2 in response to the pivotal movement of the fist cam 21*a*. At the same time, the rod 42 moves rearward (leftward as viewed in FIG. 2), pivoting the adjusting member 31 in the clockwise direction.

Figure 3:
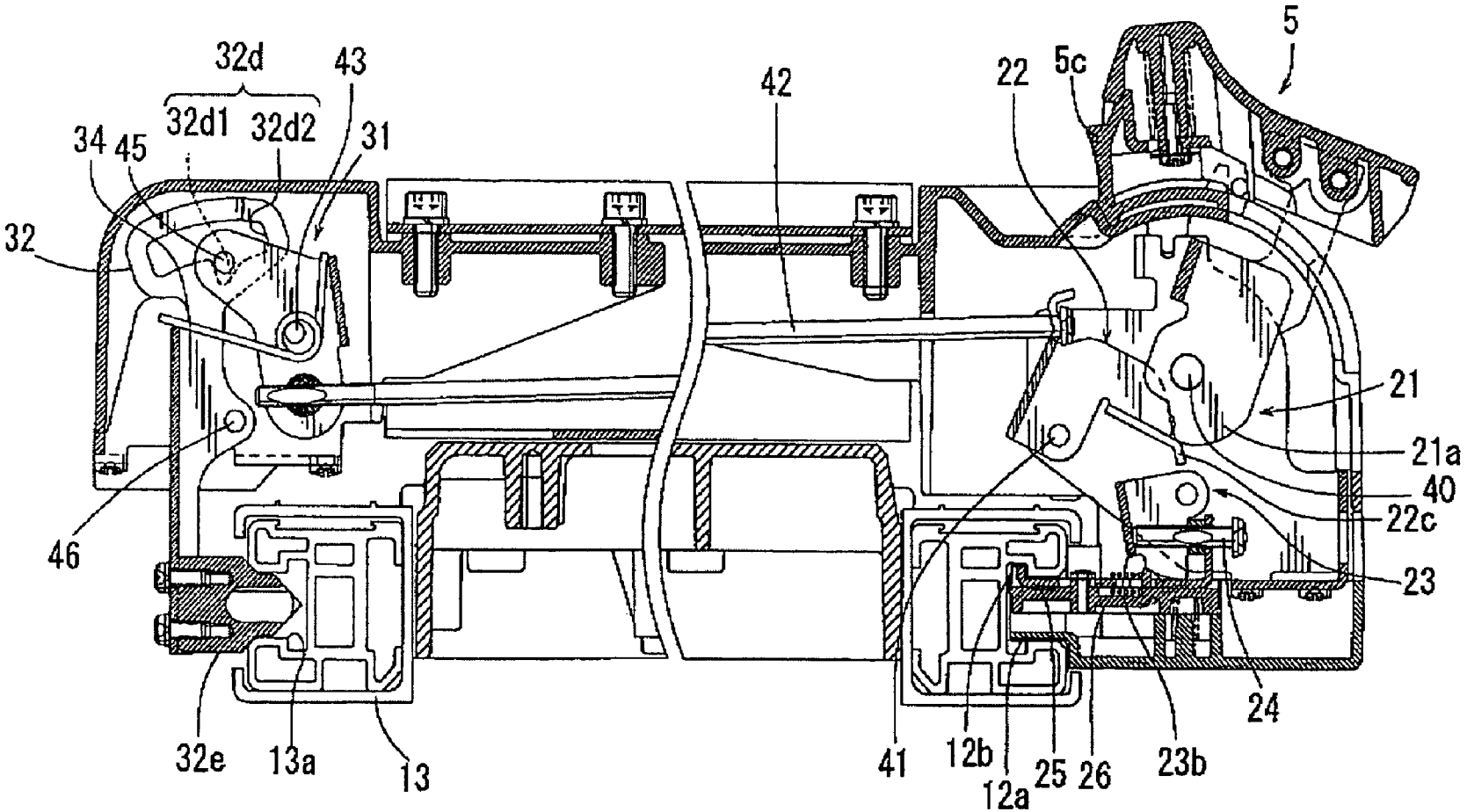
FIG. 3 is a cross-sectional view similar to FIG. 2 but showing the position adjusting state of the parallel fence.

As a result, the engaging pin 45 engaged with the narrowest width portion of the position adjusting region 32*d*1 of the insertion slot 32*d* may move to engage with a broader width portion of the position adjusting region 32*d*1 as shown in FIG. 3. The broader width portion has a width greater than the diameter of the engaging pin 45. Therefore, the engaging member 32 can pivot relative to the adjusting member 31 within an angular range limited by the width of the broader width portion of the position adjusting region 32*d*1. The pressing force applied to the engaging portion 32*e* may then be released to enable movement of the rear guide 3 along the length of the rail 13. The pivotable angular range of the engaging member 32 that is defined by the broader width portion of the position adjusting region 32*d*1 may be determined such that the engaging portion 32*e* is not completely removed from the mount portion 13*a*. With this determination, the rear guide 3 is reliably prevented from being upwardly removed from the rail 13.

Figure 7:
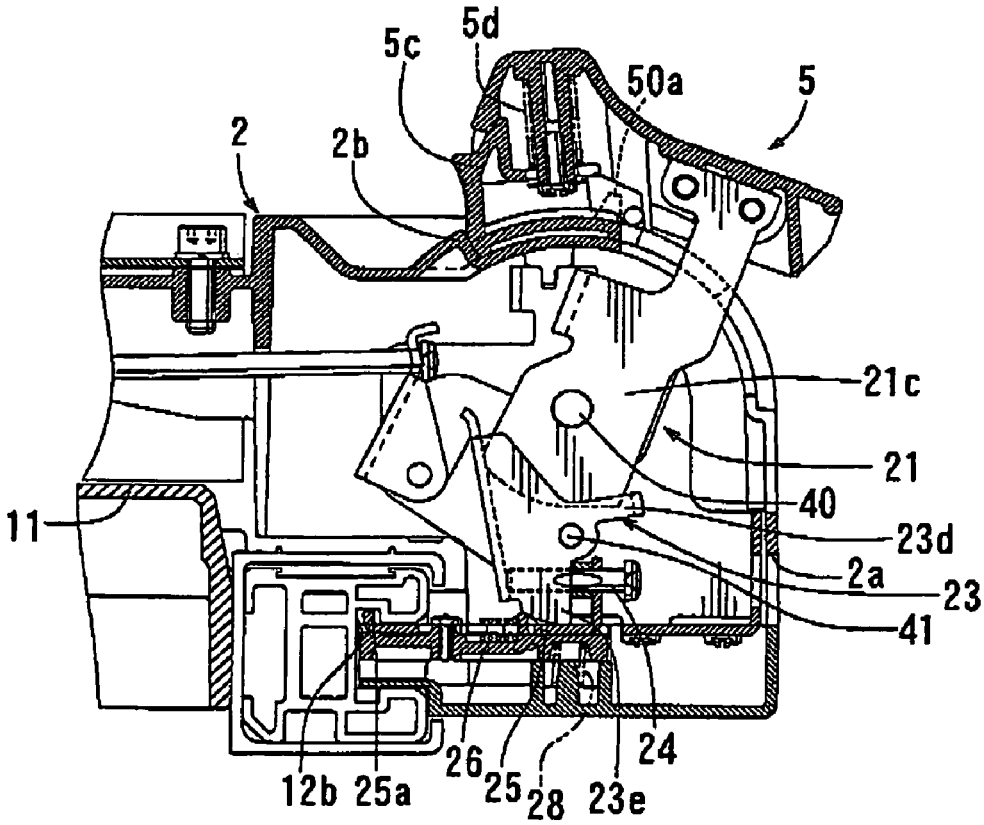
FIG. 7 is a cross-sectional view similar to FIG. 6 but showing the position adjusting state.

As the first cam 21*a* pivots in the counterclockwise direction from the position shown in FIGS. 2 and 6 to the position shown in FIGS. 3 and 7, the second cam 21*c* also pivots in a counterclockwise direction to permit the pivotal movement of the stay 23 in a clockwise direction. Therefore, the slider 25, having the adjusting screw 24 contacting the stay 23, may move rearward (leftward) due to the biasing force of the biasing member 29 (see FIG. 11). As a result, the pressing force applied by the engaging claw 25*a* against the front wall portion of the engaging recess 12*b* may be released so that the front guide 2 can be moved along the length of the front rail 12. The ribs 26*e* of the slider support 26 (see FIG. 11) may provide a guide for the movement of the front guide 2 along the front rail 12.

During the sliding movement of the front guide 2, the slider 25 may not be completely removed from the rail 12 because the movable range of the slider 25 is limited to within the length of the engaging recess 12*b* in the forward and rearward directions. In addition, the engagement of the engaging claw 25*a* with the engaging recess 12*b* is maintained because the slider 25 is still held in the horizontal position as shown in FIG. 7. Thus, the slider 25 is prevented from being removed in the forward direction and is also prevented from being removed in the upward direction.

In this way, according to the representative embodiment, the position adjusting operation of the front and rear guides 2 and 3 along the length of the front and rear rails 12 and 13 may be performed without allowing the potential removal of the front and rear guides 2 and 3 in the upward direction.

The operation for removing the front and rear guides 2 and 3 upward from the front and rear rails 12 and 13 will now be described. In order to remove the front and rear guides 2 and 3, the operator may shift the operation member 5*a* of the operation device 5 from the position shown in FIG. 3 to the rearmost position shown in FIG. 4 by pulling the stopper 5*c* upward in order to enable the stopper 5*c* to move further rearward beyond the stepped portion 2*b* of the front guide 2. Therefore, the first cam 21*a* may pivot further in the counterclockwise direction so that the hook 22 may also pivot further in the counterclockwise direction due to the biasing force that is applied by the biasing member 34 via the rod 42 and the adjusting member 31. The rod 42 may then move rearward to her pivot the adjusting member 31 in the clockwise direction.

Figure 4:
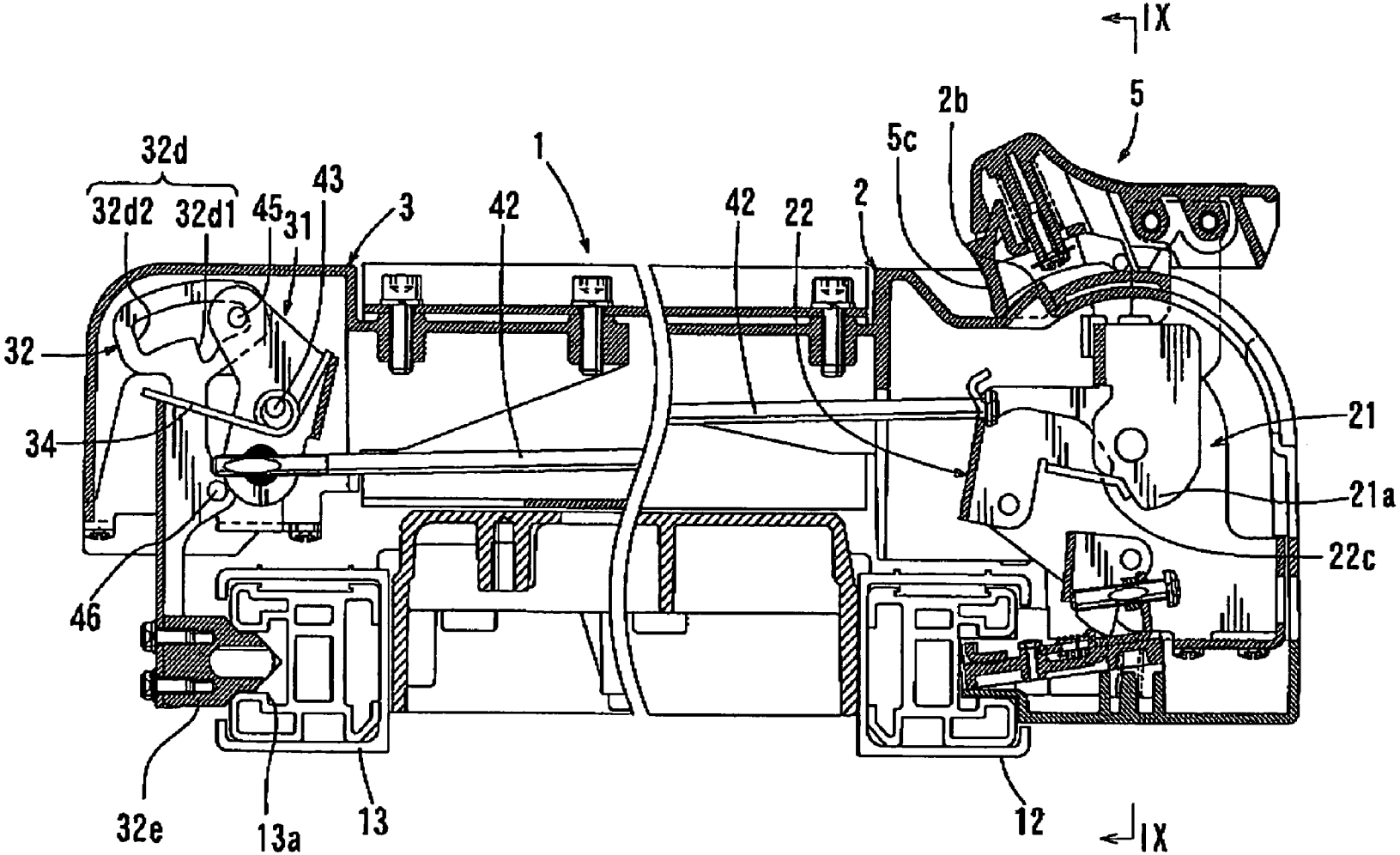
FIG. 4 is a cross-sectional view similar to FIG. 2 but showing the removing and mounting state of the parallel fence.

As the adjusting member 31 pivots farther in the clockwise direction, the engaging pin 45 may move from the position adjusting region 32*d*1 to the removing and mounting region 32*d*2 as shown in FIG. 4. Therefore, the engaging member 32 may be permitted to pivot within the broader range defined by the removing and mounting region 32*d*2.

In addition, the second cam 21*c* may pivot further in the counterclockwise direction from the position shown in FIG. 7 to the position shown in FIG. 8, allowing the stay 23 to pivot further in the clockwise direction. The backup portion 23*e* of the stay 23 moves rearward (leftward as viewed in FIG. 8) from the position shown in FIG. 7 to a position where the biasing member 28 is not positioned below the backup portion 23*e*. In other words, the backup portion 23*e* is displaced leftward from the biasing member 28 (as seen in FIG. 8).

The biasing force of the biasing member 28 may then lift the front end of the slider support 26 from below so that the slider support 26 pivots in a counterclockwise direction about the axis of the pivotal shaft 26*d* (shown in FIG. 11). In other words, the rear end of the slider support 26 moves downward. The slider 25 inclines from a horizontal position due to the pivotal movement of the slider support 26. As a result, the engaging claw 25*a* at the rear end of the slider 25 moves downward, so as to be removed from the engaging 12*b*, as shown in FIG. 8.

Figure 5:
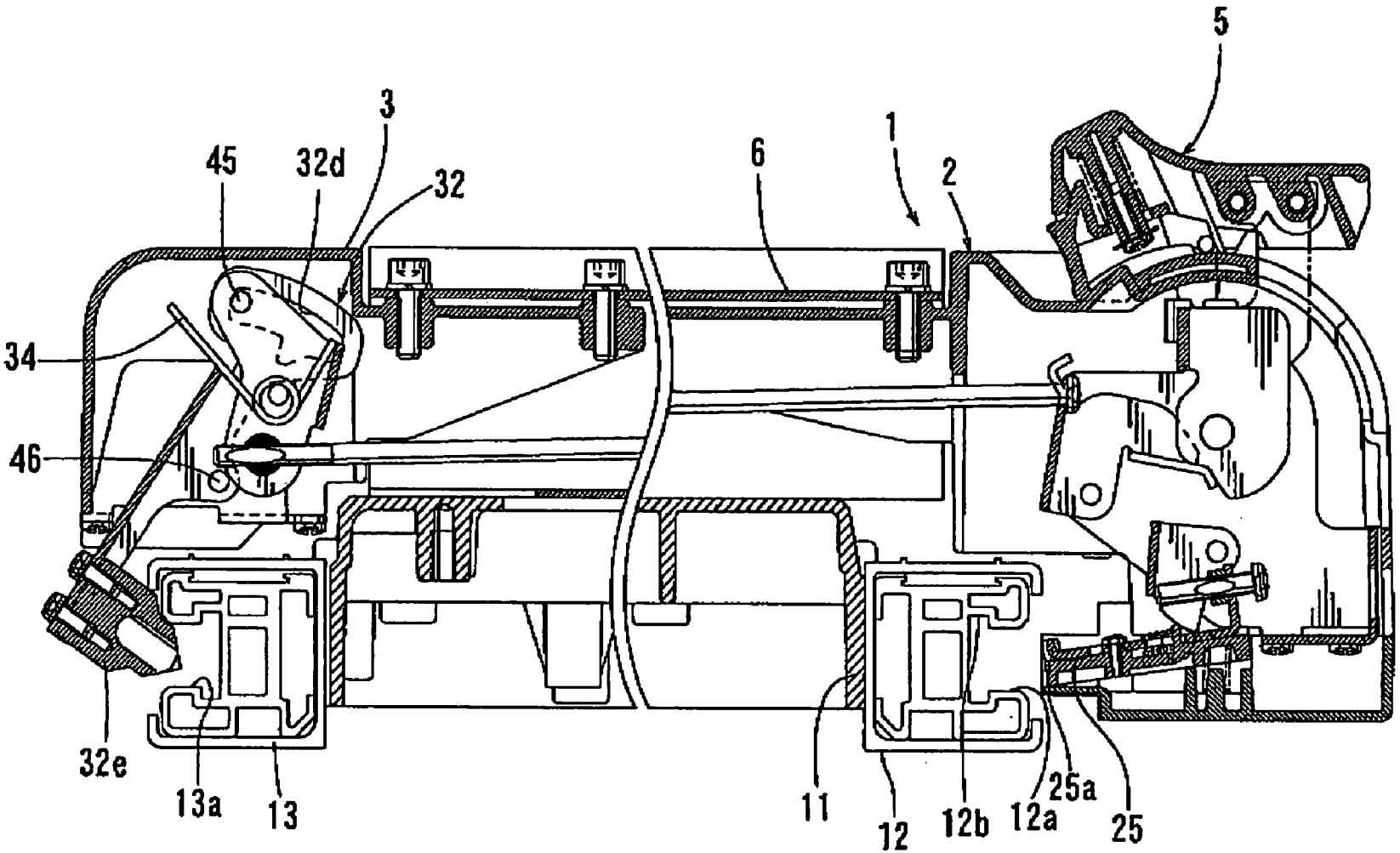
FIG. 5 is a cross-sectional view similar to FIG. 4 but showing the operation for removing the parallel fence from a worktable of the table saw.

Therefore, the front guide 2 can be removed from the front rail 12 by moving the front guide 2 forward relative to the front rail 12 as shown in FIG. 5. The front guide 2 may then be moved upward away from the upper surface of the worktable 11.

As the front guide 2 is moved forward relative to the front mail 12, the rear guide 3 is also moved forward relative to the rear rail 13. Such forward movement of the rear guide 3 relative to the rear rail 13 is possible because the engaging member 32 pivots in a clockwise diction against the biasing force of the biasing member 34. The operator may thereafter move the front guide 2 upward above the front rail 12 so that the front rail 12 no longer interacts with the front guide 2. Subsequently, the operator may move the entire parallel fence 1 rearward in order to remove the engaging portion 32*e* from the mount portion 13*a*. Finally, the operator moves the rear guide 3 upward above the rear rail 13 so that the entire parallel fence 1 is removed from the worktable 11.

The parallel fence 1 may be mounted to the wobble 11 by reversing the order of the removing steps described above. Thus, the parallel fence I may be mounted by changing the states in the following order the state shown in FIGS. 4, 5, and 8 (hereinafter called the "mounting and removing state") where mounting and removing operations can be performed; the state shown in FIGS. 3 and 7 (hereinafter called "position adjusting state") where the adjustment of the position of the parallel fence 1 can be performed; and the state shown in FIGS. 2 and 6 (hereinafter called "fixing state") where the parallel fence 1 is fixed in position. However, in order to change the state from the mounting and removing state shown to the position adjusting state, it is not necessary to separately operate the stopper 5*c* because the stopper 5*c* may automatically change position due to the biasing force of the biasing member 5*d*. In addition, as the operation member 5*b* is moved from the position shown in FIG. 8 to the position shown in FIG. 7, the slider support 26 and the slider 25 may be moved from the pivoted or inclined position to the horizontal position by the operation of the second cam 21*c* and the stay 23.

As described above, according to the representative embodiment, the positioning device 4 is configured to enable the fixing state (FIGS. 2 and 6), the position adjusting state (FIGS. 3 and 7) and the removing and mounting state (FIGS. 4, 5, and 8). In the position adjusting state, the front and rear guides 2 and 3 cannot be removed upward from the front and rear rails 12 and 13, but the front and rear guides 2 and 3 can be moved along the length of the front and rear rails 12 and 13. In other words, the position adjusting operation of the front and rear guides 2 and 3 can be performed in such a condition that the front and rear guides 2 and 3 will not be inadvertently upwardly removable from the front and rear rails 12 and 13. Therefore, the position adjusting operation of the parallel fence 1 can be easily performed without undue concern over the accidental removal of the parallel fence 1 from the worktable 11.

In addition, the positioning device 4 includes the slider 25, a control mechanism including the second cam 21*c*, the stay 23, and the adjusting screw 24, and a support mechanism including the backup portion 23*e*, the slider support 26, and the biasing member 28. The engaging claw 25*a* of the slider 25 is engageable from the lower side with the engaging recess 12*b* of the front rail 12. Permitting the engaging claw 25*a* to move in the forward and rearward directions within the engaging recess 12*b* enables the adjustability of the position of the front guide 2 (see FIG. 7). The control mechanism is operable so as to press the engaging claw 25*a* against the front wall of the engaging recess 12*b* in order to fix the front guide 2 in position (see FIG. 6). The support mechanism may be released to permit downward movement of the engaging claw 25*a*. As a result the engaging claw 25*a* may be removed from the engaging recess 12*b* so that the removing and mounting operations of the rear guide 3 can be performed (see FIG. 8).

Thus, in order to enable the positioning operation, the engaging claw 25*a* of the slider 25 is configured to engage with the engaging recess 12*b* in such a way that the engaging claw 25*a* is movable in the forward and rearward directions. In addition, because the slider 25 is held in the horizontal position by the support mechanism (see FIG. 7), the engaging claw 25*a* is prevented from being accidentally removed from the engaging recess 12*b*. Therefore, the front guide 2 may be moved along the length of the font rail 12 while the front guide 2 is reliably prevented from being removed in an upward direction from the front rail 12.

The control mechanism is operable to move the slider 25 forward so that the engaging claw 25*a* is pressed against the front wall of the engaging recess 12*b*. Consequently, the front guide 2 may be fixed in position relative to the front rail 12 (see FIG. 6). In addition, the control mechanism cooperates with the support mechanism in order to downwardly incline the slider 25 for disengaging the engaging claw 25*a* from the engaging recess 12*b*. The removing and mounting operations of the front guide 2 can be performed (FIG. 8) with the engaging claw 25*a* disengaged. These operations can be reliably performed without confusion because the slider 25 moves in a different operating direction to fix the font guide 2 than the operating direction to remove and mount the front guide 2.

The positioning device 4 further includes the engaging member 32 and the adjusting member 31 that are pivotally mounted to the rear guide 3 about different pivotal axes relative to each other. In order to adjust the pivotal position of the engaging member 32 the engaging pin 45 is mounted to the adjusting member 31 and is inserted into the insertion slot 32*d* formed in the engaging member 32. The insertion slot 32*d* includes the position adjusting region 32*d*1 and the removing and mounting region 32*d*2.

With the engaging pin 45 engaged with the narrowest width portion of the position adjusting region 32*d*1 as shown in FIG. 23 the engaging member 32 may be fixed in its pivoted position so that the rear guide 3 may also be fixed in position relative to the war rail 13. With the engaging pin 45 engaged with the broader width portion of the position adjusting region 32*d*1, as shown in FIG. 3, the engaging member 32 may be free to pivot within a limited angular range so that the rear guide 3 may be moved along the length of the rear rail 13. On the other hand, with the engaging pin 45 engaged with the removing and mounting region 32*d*2, as shown in FIG. 4, the engaging member 32 may be free to pivot by a angle larger than that permitted by the broader width portion of the position adjusting region 32*d*1. Therefore, it is possible to pivot the engaging member 32 to be completely removed from the rear rail 13. This pivoted position of the engaging member 32 enables the removing and mounting operations of the rear guide 3. Because the pivotable angular range of the engaging member 32 can be easily determined by the configurations of the position adjusting region 32*d*1 and the removing and mounting region 32*d*2 of the insertion slot 32*d*, the design of the positioning device 4 may be relatively simple.

Further, the positioning device 4 includes the operation device 5 mounted to the front guide 2 (see FIG. 6). Manipulating the operation member 5*a* of the operation device 5 allows the attainment of the fixing state, the position adjusting state, and the removing and mounting state. In addition, the stopper 5*c* is provided on the operation device 5 for preventing the operation member 5*a* from being mistakenly or inadvertently operated so as to change from the position adjusting state to the removing and mounting state. Therefore, the stopper 5*c* may also serve to prevent the parallel fence 1 from being accidentally removed from the worktable 11.

OTHER POSSIBLE EMBODIMENTS

The present invention may not be limited to the above representative embodiment but may be modified in various ways.

(1) In the above representative embodiment, the front side mechanism disposed within the front guide 2 is configured differently than the rear side mechanism disposed within the rear guide 3. However, the rear side mechanism may be configured to be the same as the front side mechanism. Thus, the rear side mechanism may also utilize a slider in order to realize a fixing state, a position adjusting state, and a removing and mounting state, of the rear guide 3.

(2) Alternatively, the front side mechanism may be configured to be the same as the rear side mechanism. Thus, the front side mechanism may also utilize an engaging member in order to realize a fixing state, a position adjusting stat; and a removing and mounting state, of the front guide 2.

(3) In the above representative embodiment, the engaging pin is provided on the adjusting member, and the insertion slot is formed in the engaging member. However, the engaging pin may be provided on the engaging member, and the insertion slot may be formed in the adjusting member.

(4) The operation device is mounted on the front guide in the above representative embodiment. However, the operation device may be mounted to the rear guide or any other part of the parallel fence.

(5) The support mechanism supports the slider such that the slider is slidable in the forward and rearward directions and is also inclinable or tiltable in the above representative embodiment. However, the support mechanism may support the slider such that the slider is slidable in the forward and rearward directions and is also movable parallel to the vertical direction between an upper position and a lower position. Thus, the upper position may permit the position adjusting operation, while the lower position may permit the removing and mounting operations.

This invention claims:

1. A parallel fence comprising:

a fence body having a front end and a rear end and arranged and constructed to be placed on a worktable;

a front guide and a rear guide respectively disposed on the front end and the rear end of the fence body; and a positioning device arranged and constructed to position and fix the front guide and the rear guide relative to a front rail and a rear rail disposed on the worktable;

wherein the positioning device has a first operational position, a second operation position and a third operational position; and wherein the first operational position fixes the front and rear guides in position respectively relative to the front and rear rails; and wherein the second operational position prevents the front and rear guides from being removed from the front and rear rails in a first direction upwardly away from a surface of the worktable and permits the front and rear guides to move in a second direction along the length of the front and rear rails; and wherein the third operational position permits the front and rear guides to be removed from the front and rear rails in the first direction;

wherein the positioning device comprises:

a slider having an engaging portion engageable with an engaging recess from a lower side of the engaging recess, wherein the engaging recess is formed in one of the front or rear rails;

a support mechanism arranged and constructed to support the slider from the lower side, so that the slider can move in a forward direction, a reward direction, and can vary a vertical position of the engaging portion;

a control mechanism arranged and constructed to control the position of the slider, so that (1) the slider is pressed against a wall of the engaging recess in the first operational position, (2) the slider is movable in the forward and rearward directions within the engaging recess in the second operational position, and (3) the engaging portion of the slider is removed from the engaging recess in the third operational position.

* * * * *